US007128774B2

(12) United States Patent
Norgren et al.

(10) Patent No.: US 7,128,774 B2
(45) Date of Patent: Oct. 31, 2006

(54) CUTTING TOOL

(75) Inventors: Susanne Norgren, Huddinge (SE); Bo Jansson, Hägersten (SE); Peter Littecke, Huddinge (SE)

(73) Assignee: Sandvik Intellectual Property AB, Sandviken (SE)

( * ) Notice: Subject to any disclaimer, the term of this patent is extended or adjusted under 35 U.S.C. 154(b) by 119 days.

(21) Appl. No.: 10/925,922

(22) Filed: Aug. 26, 2004

(65) Prior Publication Data

US 2005/0126335 A1 Jun. 16, 2005

(30) Foreign Application Priority Data

Sep. 24, 2003 (SE) ..... 0302532

(51) Int. Cl.
*C22C 29/08* (2006.01)
*B22F 7/00* (2006.01)

(52) U.S. Cl. ..... 75/244; 428/698; 75/238; 75/240; 407/119; 51/307; 51/309

(58) Field of Classification Search ..... 75/238, 75/240, 244; 428/698; 407/119; 51/307, 51/309

See application file for complete search history.

(56) References Cited

U.S. PATENT DOCUMENTS 3,507,631 A 4/1970 Yates 5,993,506 A * 11/1999 Kobayashi et al. ..... 75/240

FOREIGN PATENT DOCUMENTS

| | | |
|---|---|---|
| GB | 503 397 | 4/1939 |
| GB | 504 522 | 4/1939 |
| JP | 07-258785 | * 10/1995 |
| JP | 09-078158 | * 3/1997 |
| SE | 8 406 461 | 6/1986 |

OTHER PUBLICATIONS

Mote, J.D et al., "Investigation of a Method to Consolidate Hard Material in a Tough Matrix", Materials Science Research, Society Off Materials Science, vol. 17, 1984, pp. 696-710.

Lassner, E. et al., "Tungsten. Properties, Chemistry, Technology of the Element, Alloys and Chemical Compounds", USA, 1999, pp. 130-140.

* cited by examiner

*Primary Examiner*—Archene Turner
(74) *Attorney, Agent, or Firm*—Drinker Biddle & Reath LLP

(57) ABSTRACT

The present invention relates to a cutting tool insert for metal machining comprising tungsten carbide in a binder phase of tungsten or a tungsten alloy. The insert contains, in addition, $W_2C$ in an amount such that in the x-ray diffraction pattern the peak ratio $W_2C(101)/W(110)$ is <0.3. This particular microstructure is obtained by an additional heat treatment at about 1200° C. after the sintering.

16 Claims, 4 Drawing Sheets

CUTTING TOOL

BACKGROUND OF THE INVENTION

The present invention relates to a cutting tool for metal machining with excellent hot hardness, wear resistance and toughness in which the binder phase is metallic tungsten or a tungsten alloy, a method of making the same and the use thereof. It is particularly useful for the machining of work materials with high hardness such as hardened steel.

Cemented carbide is a well known cutting tool material for metal machining and includes a large number of alloys of a binder phase and a hard phase, where the binder mainly comprises cobalt and the hard phase mainly comprises WC, possibly with additions of cubic carbides such as TiC, TaC, NbC etc or mixtures thereof. The manufacture of cutting tools from cemented carbide involves pressing of specially prepared powder followed by sintering at a temperature where the cobalt melts. The properties of the sintered material can be varied widely in terms of toughness and hardness depending on the amount of cobalt and hard phase. In use, the hot hardness of the material determines which temperature it can be subjected to without being plastically deformed.

This can be a serious limitation especially in the area of metal cutting, making the use of more exclusive and expensive materials such as ceramics, CBN and diamond necessary.

In attempts to improve the hot hardness, the obvious way is to substitute cobalt with a metal of high melting point. However, this creates new problems, since sintering temperatures need to be very high in order to melt the binder phase and is therefore not realistic for large scale production.

GB 504 522 discloses a method of manufacturing an alloy consisting of W or Mo with additions of Co, Si and B plus WC. Sintering is performed at a temperature below the melting point of W. A mixture according to the patent consisting of between 15 and 35% W is subjected to a pressure of 16.5 MPa at a temperature between 1750° C. and 1900° C. for 15 minutes. It is contended that the process produces an alloy with metallic W as binder.

GB 503 397 relates to a method for producing an alloy consisting of the same type of binder, i.e. W or Mo with additions like cobalt, silica and boron, but in this case cubic carbides TiC, MoC and TaC as hard phase. In this case, the suggested pressure was 23.4 MPa and the temperature 2500° C.

U.S. Pat. No. 3,507,631 disclose a material consisting of different nitrides as the hard phase using Mo, W, Rh or mixtures thereof as binder. The ratio between the thermal coefficient of expansion of the binder and the nitrides should be less than 2 and as a special case up to 50% of the nitride phase may be replaced by oxides, silicates and carbides of Ti, Nb, Zr and Ta. WC is not included as hard phase. Manufacture is by hot pressing at 1800° C.

SE 8406461-7 describes pros and cons for different ways to manufacture alloys consisting of carbides, nitrides or oxides of Ti, Zr, Hf, V, Nb, Cr, Mo or W and a binder consisting of one or more of the elements Ti, Zr, Hf, V, Nb, Cr, Mo or W. An example of a manufacturing method involves powder pressing, pre-sintering, final sintering and isostatic pressing. The binder phase content is relatively high, at least 25% by volume and as high as 70% by volume. It is also stated that performance in metal cutting is about five times better than the corresponding commercially available cemented carbide grade.

In an attempt to produce an alloy with 18% WC in a binder phase of W, it was proceeded according to the invention disclosed in the above mentioned GB 504 522. However, it was found that the process conditions suggested in the patent actually produced a brittle material with low hardness. It was specifically found that the process conditions suggested in the patent will actually produce an alloy where most of the W is transformed into $W_2C$. This is not mentioned in the patent and it is reasonable to assume that limitations in the laboratory equipment at the time of invention failed to indicate this.

OBJECTS AND SUMMARY OF THE INVENTION

It is an object of the present invention to provide a homogenous alloy without porosity where the binder is essentially made up by metallic tungsten or alloy thereof and a way of manufacturing the same.

In one embodiment, there is provided a cutting tool insert for metal machining comprising tungsten carbide in a binder phase of tungsten or a tungsten alloy and $W_2C$ in an amount such that in the x-ray diffraction pattern by the Cu K$\alpha$-line from the surface of the insert the peak ratio $W_2C(101)/W(110)$ is <0.3.

In another embodiment, there is provided the method of making a cutting tool insert for metal machining containing tungsten carbide in a binder phase of tungsten or a tungsten alloy comprising mixing powders of tungsten carbide and optionally other hard constituents and tungsten, consolidating the mixture at temperatures above 1500° C. to blanks containing $W_2C$, grinding the blanks to inserts of desired shape and dimension and subjecting said blanks or inserts to a heat treatment at <1250° C. in an inert atmosphere or vacuum for a period of time necessary to retransform essentially all of the $W_2C$ to W and WC.

In yet another embodiment, there is provided the use of the insert described above for machining of work materials with high hardness.

BRIEF DESCRIPTION OF THE FIGURES

FIG. 3 shows a scanning electron microscope image in 10000× the microstructure of the prior art material and FIG. 4 from the material according to the invention in which

A-WC

B-$W_2C$ and

C-W.

Figure 5:
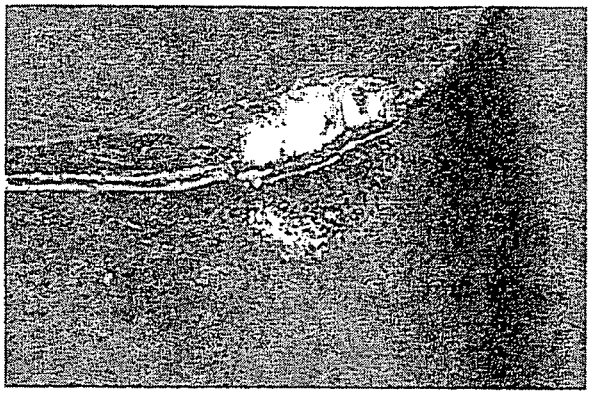
Figure 6:
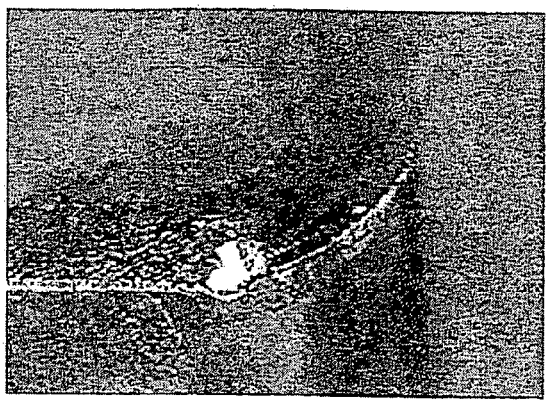

FIG. 5 shows the wear pattern of a reference insert and FIG. 6 shows that of an insert according to the invention after a machining test.

DESCRIPTION OF THE PREFERRED EMBODIMENTS OF THE INVENTION

According to the present invention there is now provided a cutting tool insert for metal machining containing tungsten carbide in a binder phase of tungsten or a tungsten alloy. The binder content of the insert is from about 2–25, preferably from about 5–20 vol %, with an average WC grain size of <5 μm. The insert may contain $W_2C$ in residual amounts after the heat treatment disclosed below, in an amount such that in the x-ray diffraction pattern the peak ratio $W_2C(101)/W(110)$ is <0.3, preferably <0.2, most preferably <0.15. The height of the diffraction peaks is measured from the base line without taking the background into consideration.

In one embodiment, the average WC grain size is about 1–3 μm.

In a preferred embodiment, the average WC grain size is <1 μm with essentially no (that is, less than 5%) grains>1.5 μm.

In yet another embodiment, the insert has a bimodal WC grain size distribution.

In addition to WC, the inserts may contain at least one hard constituent with a room temperature hardness of more than 1400 HV3. The amount by volume of said constituent is preferably less than about 50% by volume. Preferably said hard constituent is TiC, TaC, NbC and/or VC and/or mixed carbides thereof.

The insert can be provided with a thin wear resistant coating as known in the art, preferably 4–10 μm Ti(C,N)+ 5–13 μm $Al_2O_3$.

The present invention also relates to a method of making a cutting tool insert for metal machining containing tungsten carbide in a binder phase of tungsten or a tungsten alloy by mixing powders of tungsten carbide and tungsten alloy by milling, sintering the mixture to blanks containing $W_2C$ and grinding the blanks to inserts of desired shape and dimension. The consolidation of the material is enhanced by applying an external pressure during the sintering by methods known in the art. Surprisingly, it has been found that if the manufacturing process includes a heat treatment at about 1200° C. the toughness can be substantially improved without compromising hardness. Increasing W content over 25% by volume will lower the hardness without increasing toughness making the suitable share of binder between 5 and 25% by volume. The reason for specifying so high amount of binder in earlier publications could be that it was not observed that the binder actually consisted of $W_2C$, rather than metallic tungsten as originally intended. According to the invention, said blanks are subjected to a heat treatment at <1250° C., preferably >1000° C., in inert atmosphere or vacuum for a period of time necessary to retransform essentially all of the $W_2C$ to W and WC. Alternatively, the heat treatment of the blanks is performed as a second step in the sintering cycle prior to the grinding of the blanks into inserts in the same or different furnace or after grinding the blanks to inserts.

The invention further relates to the use of an insert for machining of work materials with high hardness such as hardened steel.

The invention is additionally illustrated in connection with the following Examples, which are to be considered as illustrative of the present invention. It should be understood, however, that the invention is not limited to the specific details of the Examples.

EXAMPLE 1 (PRIOR ART)

A powder mixture of 18 weight-% W and remainder WC with an initial FSSS grain size of 0.25 μm was wet milled for 8 h in a ball mill with cemented carbide milling bodies. After drying, the powder was hot pressed at 1800° C. under vacuum (p<0.1 mbar) for 70 minutes in a graphite die into a disk of 45 mm in diameter and 5 mm in height, applying a mechanical pressure of 30 MPa.

EXAMPLE 2 (INVENTION)

Half of the disc from Example 1 was heat treated in argon gas at 1200° C. for 8 hours.

EXAMPLE 3 (INVENTION)

A powder mixture of 10% W by volume and remainder WC with an initial FSSS grain size of 0.25 μm was processed according to Example 1 and heat treated according to Example 2.

EXAMPLE 4

Polished samples were prepared from bodies obtained in Examples 1, 2, 3 and 4 which were analysed by x-ray diffraction analysis and scanning electron microscopy.

Figure 1:
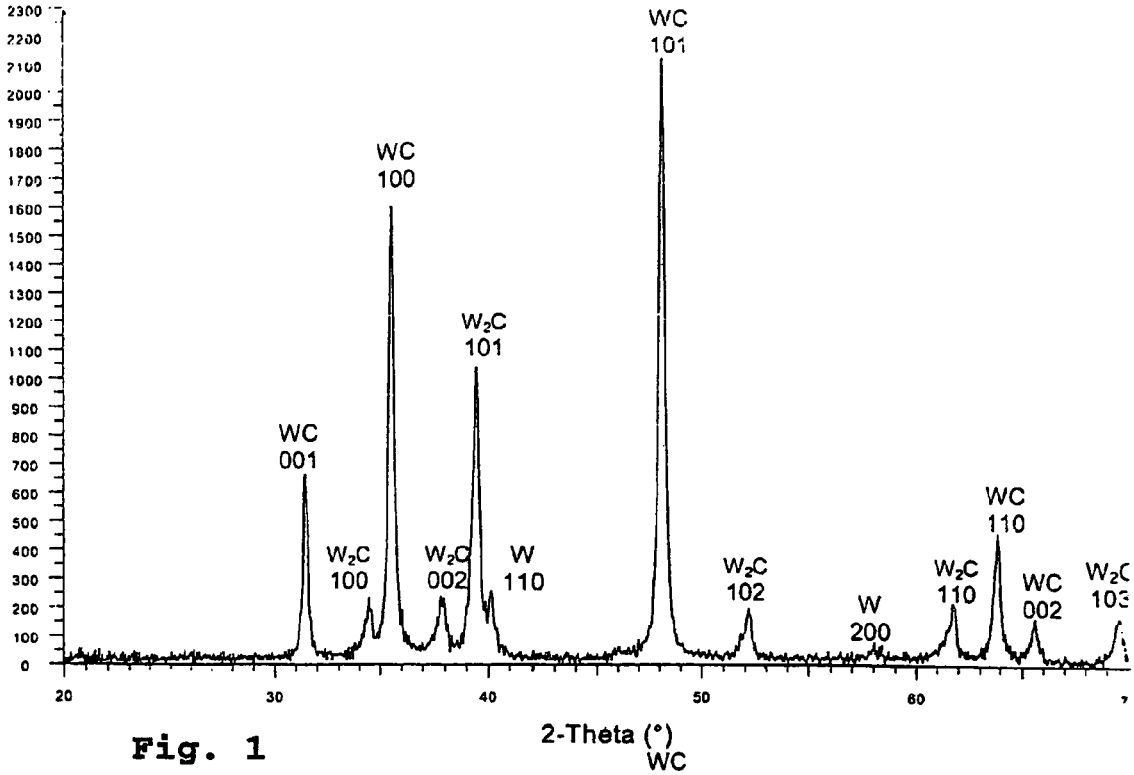
FIG. 1 shows X-ray diffraction patterns from an alloy according to prior art.
Figure 2A:
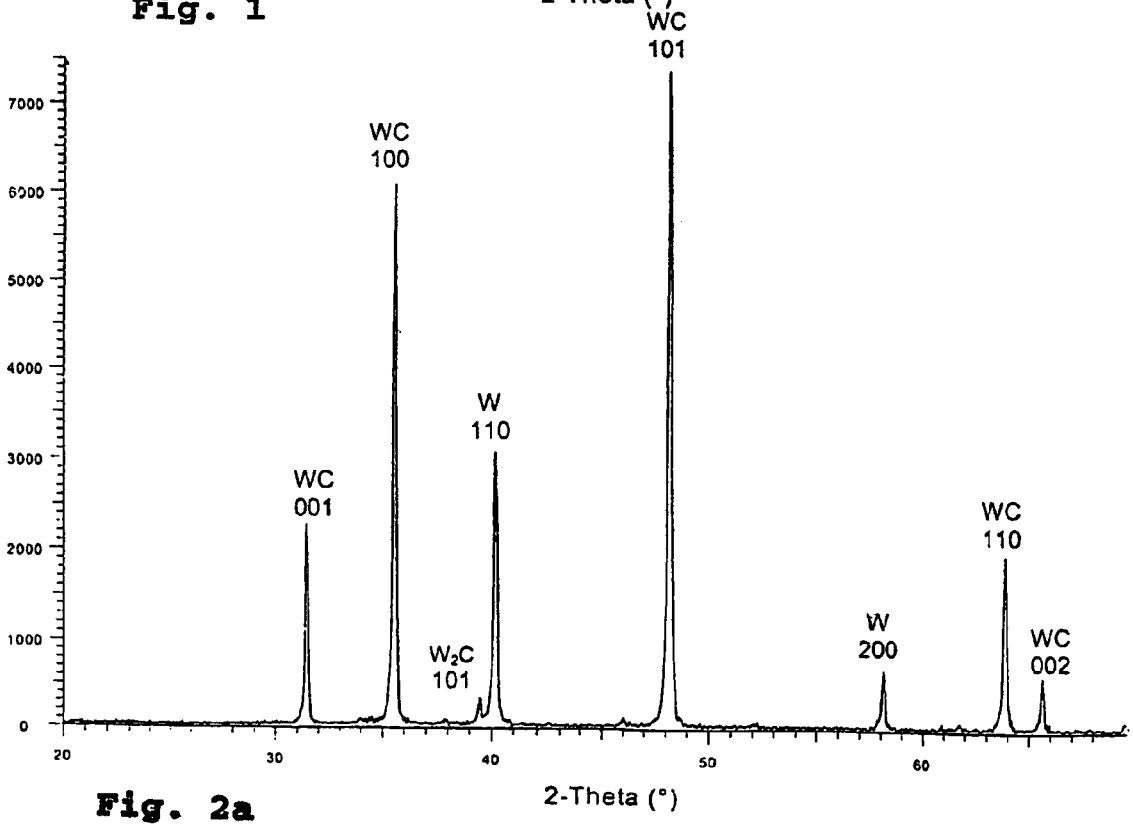
FIGS. 2*a* and 2*b* show X-ray patterns from alloys with compositions according to the present invention before and after heat treatment. JCPDS PDF-cards used for identification are: WC Card no: 25-1047 (Bind and McCarthy Penn State University, University Park Pennsylvania, USA JCPDS Grant-in-aid report (1973)) and W card no: 04-0806 (Swanson and Tatge JC. Fel. Rep. NBS (1951)) and $W_2C$ card no: 35-0776 (Nat. Bur. Stand. (US) Monogr. 25, 21, 128 (1984))
Figure 2B:
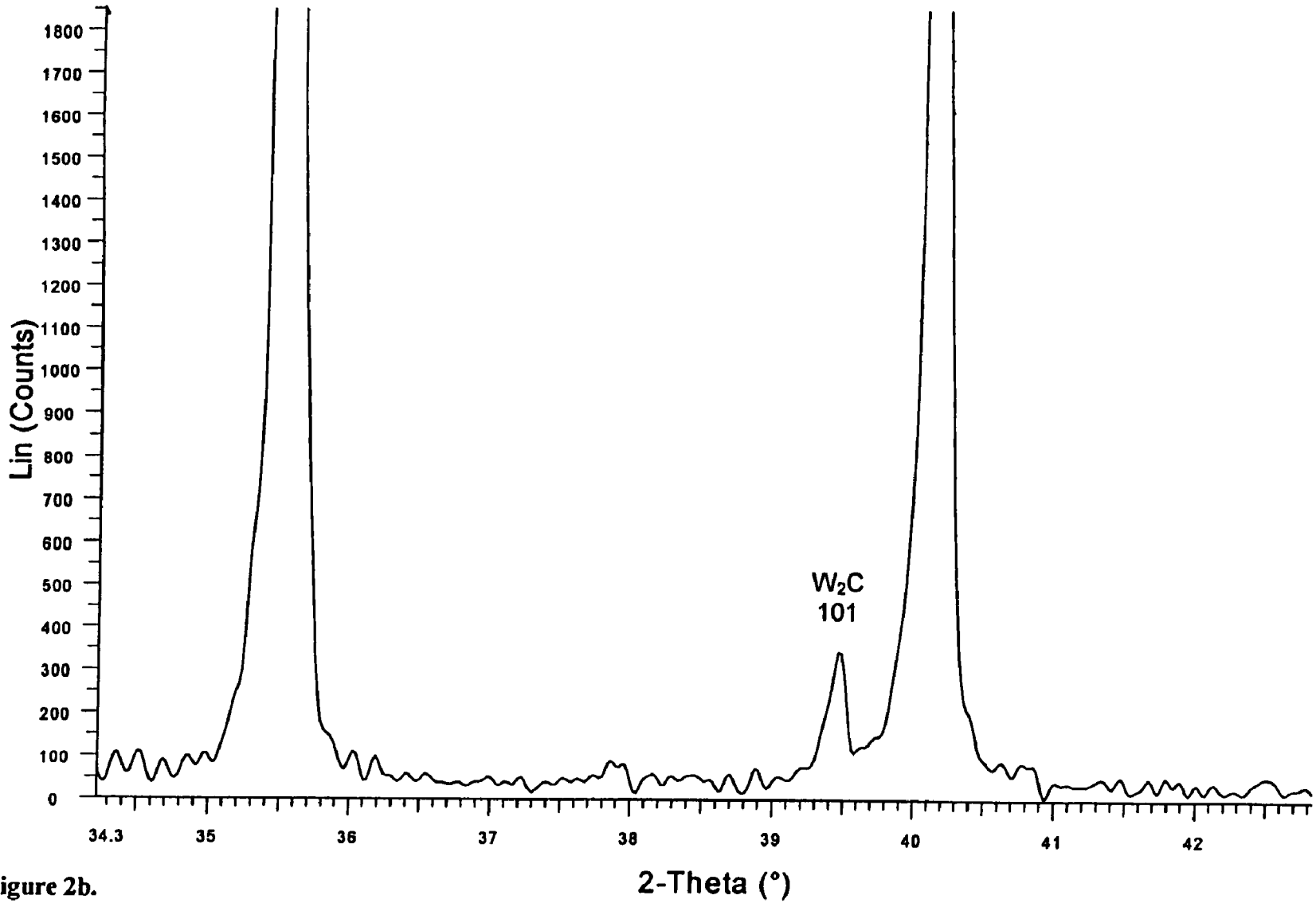

In the X-ray diffraction pattern of the sample from Example 1, peaks for $W_2C$, WC and some W were found, see FIG. 1. However, the diffraction patterns of the samples from Example 2 and 3 showed W, WC and the X-ray peak ratio $W_2C(101)/W(110)$ to be 0.11, as shown in FIG. 2*a* (sample from Example 3) and enlargement of the $W_2C(101)$ in FIG. 2*b* (sample from Example 3).

Figure 3:
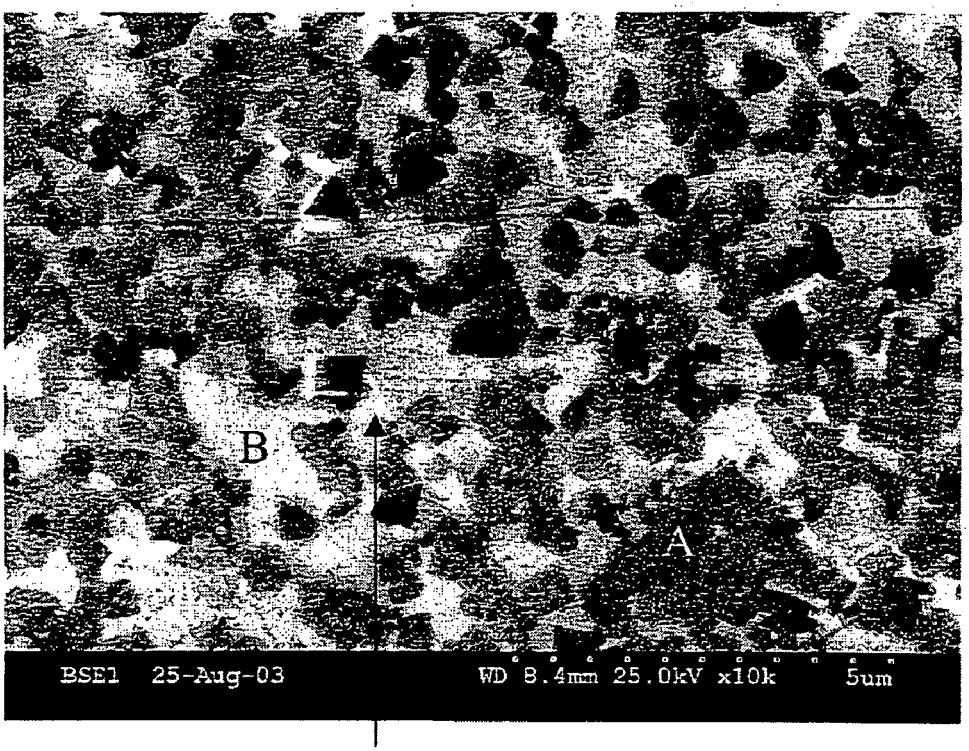
Figure 4:
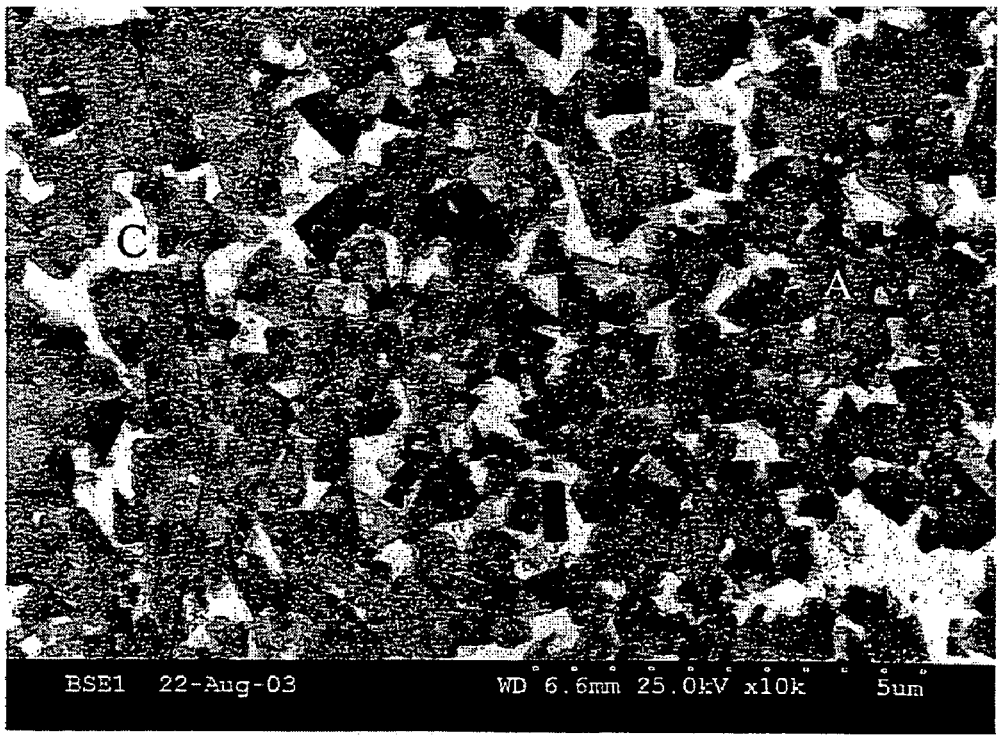

The microstructures of the sample from Example 1 and Example 2 are shown in FIG. 3 and FIG. 4 respectively in 10000× magnification in which

A-WC

B-$W_2C$ and

C-W.

The WC grain size was also determined by the intercept method and it was found to be 0.5 μm for the sample from Example 1 and 0.8 μm for the sample from Example 2.

In addition hardness, HV3 at room temperature, HV1 at 900° C. and K1C (according to the indentation method) at room temperature were determined with the following results:

| Example | HV3 | HV1 at 900° C. | K1C, MPam1/2 | |
|---|---|---|---|---|
| 1 | 2250 | — | 3.7 | prior art |
| 2 | 1789 | 1260 | 6.4 | invention |
| 3 | 2192 | 1450 | 5.1 | invention |

EXAMPLE 5

Example 3 was repeated to make inserts of type SNG432. The inserts were coated with a wear resistant coating consisting of about 6 μm Ti(C,N) and about 5 μm $Al_2O_3$.

As a reference, cemented carbide insert with a cobalt content of 6% by weight and the same coating was used.

The inserts were subjected to a machining test in hardened ball bearing steel with a hardness>60 HRC at a cutting speed of 180 m/min, feed 0.1 mm/rev and a depth of cut of 0.15 mm.

FIG. 5 shows the appearance of the wear pattern of the reference after machining three components and FIG. 6 shows that of the insert according to the invention after machining of twelve components.

EXAMPLE 6 INVENTION

A powder mixture of 10% W by volume and remainder of WC with an initial FSSS grain size of 0.25 μm and 30 vol-% (Ti,W)C or (Nb,W)C was processed according to Example 1 and heat treated according to Example 2 but at a temperature of 1050° C. for (Ti,W)C and 1100° C. for (Nb,W)C for 8 h such that in the X-ray diffraction patterns of the heat treated structure the $W_2C(101)$ peak was not detectable.

The principles, preferred embodiments, and modes of operation of the present invention have been described in the foregoing specification. The invention, which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. Cutting tool insert for metal machining comprising:

tungsten carbide in a binder phase of tungsten or a tungsten alloy; and $W_2C$ in an amount such that, in the x-ray diffraction pattern by the Cu Kα-line from the surface of the insert, a peak ratio $W_2C(101)/W(110)$ is <0.3.

2. The cutting tool insert of claim 1 wherein said peak ratio is <0.2.

3. The cutting tool insert according to claim 1 wherein a binder phase content is from about 2–25 vol-% of the insert.

4. The cutting tool insert of claim 3 wherein the binder phase content is from about 5–20 vol-% of the insert.

5. The cutting tool insert of claim 1 wherein an average WC grain size is <5 μm.

6. The cutting tool insert according to claim 5 wherein the average WC grain size is 1–3 μm.

7. The cutting tool insert of claim 5 wherein the average WC grain size is <1 μm with essentially no grains >1.5 μm.

8. The cutting tool insert of claim 1 wherein said insert contains at least one hard constituent with a room temperature hardness of more than 1400 HV3.

9. The cutting tool insert of claim 8 wherein said hard constituent is chosen from the group consisting of TiC, TaG, NbC, VC and mixtures thereof.

10. The cutting tool insert of claim 8 wherein an amount of said at least one hard constituent is less than about 50 vol-%.

11. The cutting tool insert of claim 1 wherein the insert is provided with a wear resistant coating.

12. The cutting tool insert of claim 1 wherein the insert has a bimodal WC grain size distribution.

13. The cutting tool insert of claim 2 wherein said peak ratio is about 0.1.

14. Method of making a cutting tool insert for metal machining containing tungsten carbide in a binder phase of tungsten or a tungsten alloy comprising mixing powders of tungsten carbide and optionally other hard constituents and tungsten, consolidating the mixture at temperatures above 1500° C. to blanks containing $W_2C$, grinding the blanks to inserts of desired shape and dimension and subjecting said blanks or inserts to a heat treatment at <1250° C., in an inert atmosphere or vacuum for a period of time necessary to retransform essentially all of the $W_2C$ to W and WC.

15. The method of claim 14 wherein said blanks are subjected to a heat treatment at >1000° C.

16. The use of the insert of claim 1 for machining of work materials with high hardness.

* * * * *